US010619865B2

(12) United States Patent
Niimura et al.

(10) Patent No.: US 10,619,865 B2
(45) Date of Patent: Apr. 14, 2020

(54) AIR-CONDITIONING UNIT

(71) Applicant: Mitsubishi Electric Corporation, Tokyo (JP)

(72) Inventors: Takuya Niimura, Tokyo (JP); Kazuhito Kojima, Tokyo (JP); Yasushi Oba, Tokyo (JP); Hiroshi Omura, Tokyo (JP); Shota Sugai, Tokyo (JP); Den Ozaki, Tokyo (JP); Yosuke Naito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 763 days.

(21) Appl. No.: 14/633,357

(22) Filed: Feb. 27, 2015

(65) Prior Publication Data

US 2015/0300678 A1 Oct. 22, 2015

(30) Foreign Application Priority Data

Apr. 21, 2014 (JP) ..... 2017-087559

(51) Int. Cl.
*F24F 13/20* (2006.01)
*F24F 1/0057* (2019.01)
(Continued)

(52) U.S. Cl.
CPC ..... *F24F 1/0057* (2019.02); *F24F 13/20* (2013.01); *A47B 96/067* (2013.01); *F24F 1/0007* (2013.01)

(58) Field of Classification Search
CPC ..... F24F 13/082; F24F 13/20; F24F 1/0007; E04B 1/6179; A47B 47/022;
(Continued)

(56) References Cited

U.S. PATENT DOCUMENTS 3,663,990 A * 5/1972 Shane ..... E05D 1/04 16/269
4,133,507 A * 1/1979 Chervenak ..... A47B 95/008 248/223.41
(Continued)

FOREIGN PATENT DOCUMENTS

CN 1071439 C 9/2001
CN 203131985 U 8/2013
(Continued)

OTHER PUBLICATIONS

Office Action dated May 23, 2017 issued in corresponding JP application No. 2014-087559 (and English translation).
(Continued)

*Primary Examiner* — Edelmira Bosques
*Assistant Examiner* — Frances F. Hamilton
(74) *Attorney, Agent, or Firm* — Posz Law Group, PLC

(57) ABSTRACT

To obtain an air-conditioning apparatus with good operability.

The air-conditioning apparatus includes a main body 1 including a frame body 2 and a base body 3 provided on a back surface side of the frame body 2, a frame body-side engagement section 2*a* and an extension section 2*b* that extends backward on both sides of the frame body-side engagement section 2*a* are provided on a back side of the frame body 2, a base body-side engagement section 3*a* that engages with the frame body-side engagement section 2*a*, and a support base 3*b* that is located below the extension section 2*b* are provided on a front side of the base body 3, and when the frame body 2 is mounted to the base body 3, the frame body-side engagement section 2*a* and the base body-side engagement section 3*a* engage with each other, and the extension section 2*b* is supported by the support base 3*b*.

5 Claims, 5 Drawing Sheets

(51) Int. Cl.
*A47B 96/06* (2006.01)
*F24F 1/0007* (2019.01)

(58) Field of Classification Search
CPC ..... A47B 2230/16; A47B 2230/14; A47B 2230/0096; A47B 96/067; A47B 96/027
USPC ..... 52/36.4, 36.5; 312/245, 199
See application file for complete search history.

(56) References Cited

U.S. PATENT DOCUMENTS 4,211,379 A * 7/1980 Morgan ..... A47B 96/067 248/222.51
4,240,264 A * 12/1980 Nakada ..... F24F 1/0007 165/122
4,542,831 A * 9/1985 Dazza ..... A47K 1/05 108/42
4,570,814 A * 2/1986 Seeley ..... F24F 13/20 220/4.28
4,591,058 A * 5/1986 Amstutz ..... A47F 5/0846 211/189
5,038,539 A * 8/1991 Kelley ..... A47B 21/06 211/190
5,309,686 A * 5/1994 Underwood ..... A47B 83/001 160/135
5,454,638 A * 10/1995 Bird ..... A47B 57/42 108/108
5,575,326 A * 11/1996 Asami ..... F24F 1/0007 165/122
5,657,817 A * 8/1997 Heine ..... F28D 1/0435 165/140
6,158,500 A * 12/2000 Heine ..... B60K 11/04 165/140
6,315,257 B1 * 11/2001 Fennesz ..... F24D 19/04 248/209
6,364,262 B1 * 4/2002 Gibson ..... A47F 5/0068 248/229.14
6,435,632 B1 * 8/2002 Correa ..... F24F 13/20 312/236
6,446,396 B1 * 9/2002 Marangoni ..... A47B 96/027 108/50.02
6,497,463 B2 * 12/2002 Moretti ..... F24F 13/20 312/236
6,772,905 B2 * 8/2004 Cheng ..... B65D 43/166 16/355
6,854,234 B2 * 2/2005 Gimpel ..... E04B 1/6162 160/135
7,086,542 B2 * 8/2006 Tomonari ..... A47B 96/067 211/94.01
8,104,850 B2 * 1/2012 Hager ..... A47B 47/02 312/245
8,505,327 B2 * 8/2013 Son ..... F24F 1/0007 62/407
8,864,407 B1 * 10/2014 Sorum ..... F16B 5/008 403/381
2002/0171337 A1 * 11/2002 Moretti ..... F24F 13/20 312/236
2004/0035080 A1 * 2/2004 Becker ..... E04F 13/0878 52/592.1
2004/0074048 A1 * 4/2004 Danev ..... B62D 27/06 16/227
2006/0201184 A1 * 9/2006 Ito ..... F24F 1/0007 62/298
2007/0044496 A1 * 3/2007 Ha ..... F24F 1/027 62/262
2010/0287973 A1 * 11/2010 Son ..... F24F 1/0007 62/407
2011/0048050 A1 * 3/2011 Moteki ..... F24F 1/0007 62/263
2011/0211944 A1 * 9/2011 Ohishi ..... F24F 1/0011 415/182.1
2012/0273633 A1 * 11/2012 Henriott ..... A47B 96/067 248/205.1
2014/0191637 A1 * 7/2014 Zhang ..... F24F 1/0057 312/223.1
2014/0252820 A1 * 9/2014 Botello ..... F16M 13/02 297/188.04
2018/0283730 A1 * 10/2018 Suzuki ..... F24F 13/20

FOREIGN PATENT DOCUMENTS

DE 4242180 A1 * 6/1994 ..... F16B 5/0032
EP 1808645 A2 7/2007
JP 09-112948 A 5/1997
JP 09112948 * 5/1997
JP 11-159795 A 6/1999
JP 2000-161695 A 6/2000
JP 2013-167400 A 8/2013
JP 2013167400 A * 8/2013 ..... F24F 13/20

OTHER PUBLICATIONS

Extended European Search Report dated Sep. 2, 2015 in the corresponding EP application No. 15160098.8.
Office Action dated Jul. 3, 2017 issued in corresponding CN application No. 201510190827.8 (and English translation).
European Office action dated Nov. 14, 2019 issued in corresponding EP patent application No. 15160098.8.

* cited by examiner

AIR-CONDITIONING UNIT

TECHNICAL FIELD

The present invention relates to an air-conditioning apparatus.

BACKGROUND ART

Conventionally, there has been an air-conditioning apparatus including an indoor unit composed of a front surface panel and a unit body (for example, see Patent Literature 1). In the air-conditioning apparatus described in Patent Literature 1, a recessed portion provided in the front surface panel and an engagement claw provided in the unit body engage with each other, so that the front surface panel is mounted to the unit body, and the front surface panel is thereby prevented from falling.

CITATION LIST

Patent Literature

Patent Literature 1: Japanese Patent Laid-Open No. 9-112948 ([0119] to [0121], FIG. 11)

SUMMARY OF INVENTION

Technical Problem

In the air-conditioning apparatus described in Patent Literature 1, when an engagement allowance between the front surface panel (a frame body) and the unit body (a base body) is reduced, an engagement state between the front surface panel and the unit body can be easily released, for example, at the time of maintenance, while the engagement state between the front surface panel and the unit body is not firm.

Also, in the air-conditioning apparatus described in Patent Literature 1, when the engagement allowance between the front surface panel (the frame body) and the unit body (the base body) is increased, the engagement state between the front surface panel and the unit body becomes firm, while the engagement state between the front surface panel and the unit body cannot be easily released, for example, at the time of maintenance.

In the air-conditioning apparatus described in Patent Literature 1, since it is not possible to easily release the engagement state between the front surface panel and the unit body while making firm the engagement state between the front surface panel and the unit body, there is a problem that operability is poor.

The present invention has been made based on the aforementioned problem, and an object thereof is to provide an air-conditioning apparatus with good operability.

Solution to Problem

An air-conditioning apparatus according to the present invention includes a main body including a frame body and a base body provided on a back surface side of the frame body, a frame body-side engagement section and an extension section that extends backward on both sides of the frame body-side engagement section are provided on a back side of the frame body, a base body-side engagement section that engages with the frame body-side engagement section, and a support base that is located below the extension section are provided on a front side of the base body, and when the frame body is mounted to the base body, the frame body-side engagement section and the base body-side engagement section engage with each other, and the extension section is supported by the support base.

Advantageous Effects of Invention

In accordance with the present invention, when the frame body is mounted to the base body, the frame body-side engagement section and the base body-side engagement section engage with each other, and the extension section is supported by the support base. Thus, it is possible to easily release an engagement state between the frame body and the base body while ensuring an engagement allowance. Therefore, the air-conditioning apparatus with good operability can be obtained.

DESCRIPTION OF EMBODIMENTS

Figure 1:
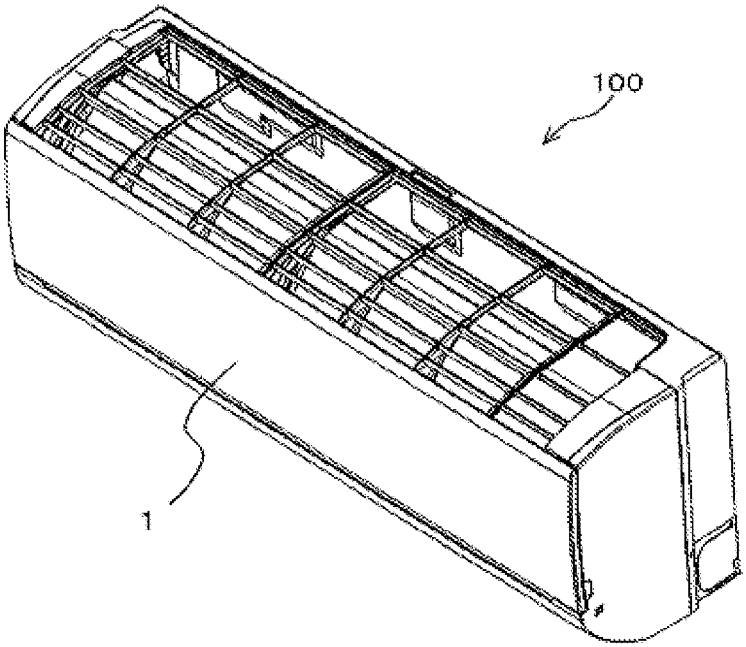
FIG. 1 is an overall perspective view of an air-conditioning apparatus 100 according to an embodiment of the present invention.
Figure 2:
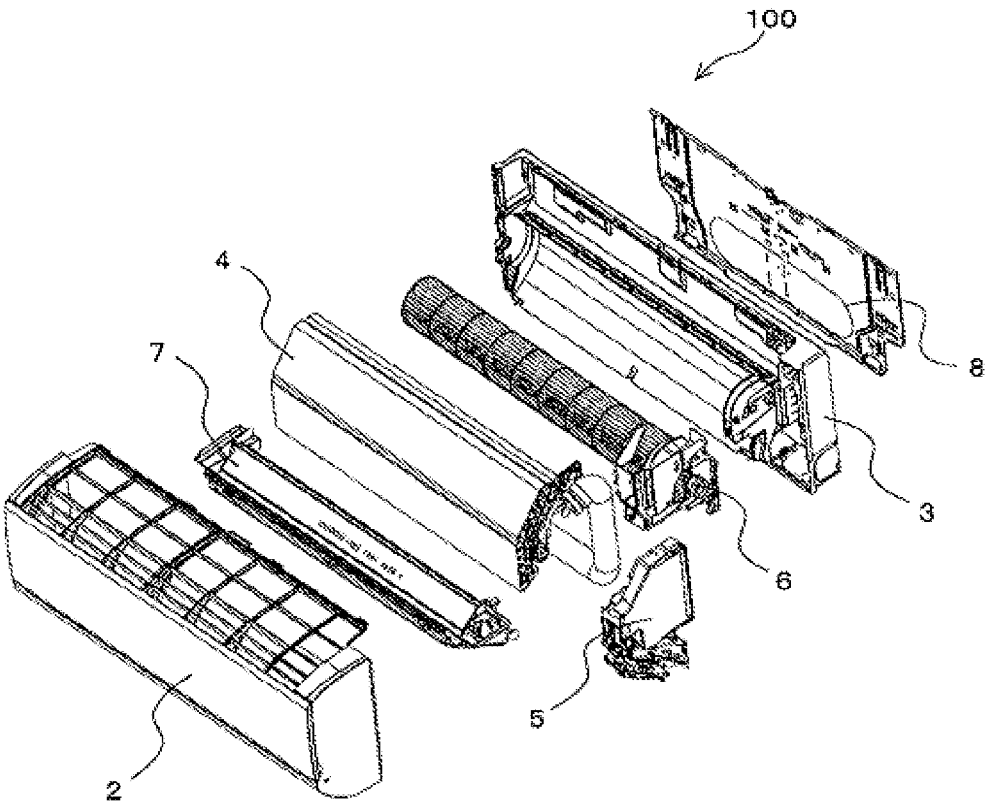
FIG. 2 is an exploded perspective view of the air-conditioning apparatus 100 according to the embodiment of the present invention.

FIG. 1 is an overall perspective view of an air-conditioning apparatus 100 according to an embodiment of the present invention. FIG. 2 is an exploded perspective view of the air-conditioning apparatus 100 according to the embodiment of the present invention.

As shown in FIG. 1, an outer shell of the air-conditioning apparatus 100 (an indoor unit) is composed of a main body 1. The main body 1 is composed of a frame body 2, a base body 3, and an installation plate 8 as shown in FIG. 2. The frame body 2 is a member that constitutes a front surface and a top surface of the main body 1. The base body 3 is a member that constitutes a back surface of the main body 1, and is provided on the back surface side of the frame body 2. The installation plate 8 is a member that is installed on, for example, a wall or a pillar. The base body 3 is mounted to the installation plate 8. A heat exchanger 4, an electric parts box 5, an air blowing unit 6, and a drain pan unit 7 are provided within the main body 1.

The heat exchanger 4 is a heat exchanger that functions as an evaporator at the time of cooling, and functions as a condenser at the time of heating. The electric parts box 5 accommodates parts such as a control board (not shown). The air blowing unit 6 is a unit having a fan (not shown) and a motor (not shown) that rotates the fan. The drain pan unit 7 is a unit that receives dew condensation water generated in the heat exchanger 4.

In the following, assembling of the air-conditioning apparatus 100 is described.

First, the heat exchanger 4, the electric parts box 5, the air blowing unit 6, and the drain pan unit 7 are attached to the base body 3. Subsequently, the frame body 2 is mounted to the base body 3, and the base body 3 is hooked to the installation plate 8 in a state in which the installation plate 8 is installed on a wall or a pillar. Accordingly, the air-conditioning apparatus 100 is assembled.

Figure 3:
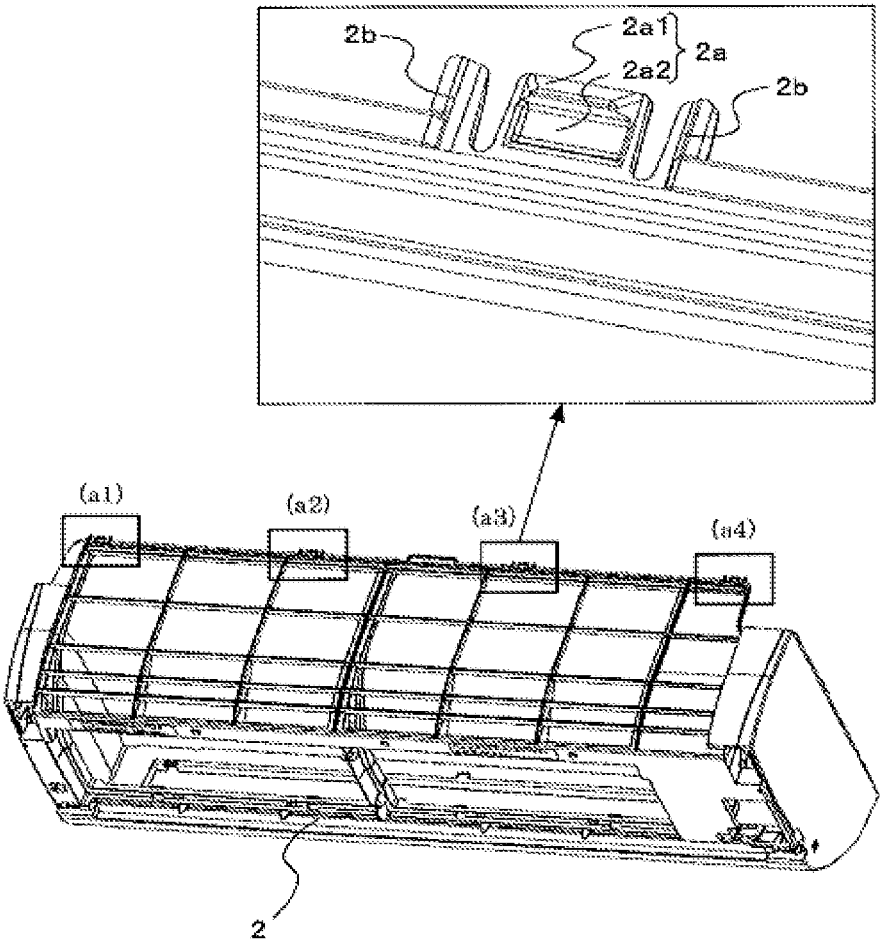
FIG. 3 is a view illustrating a frame body 2 of the air-conditioning apparatus 100 according to the embodiment of the present invention.
Figure 4:
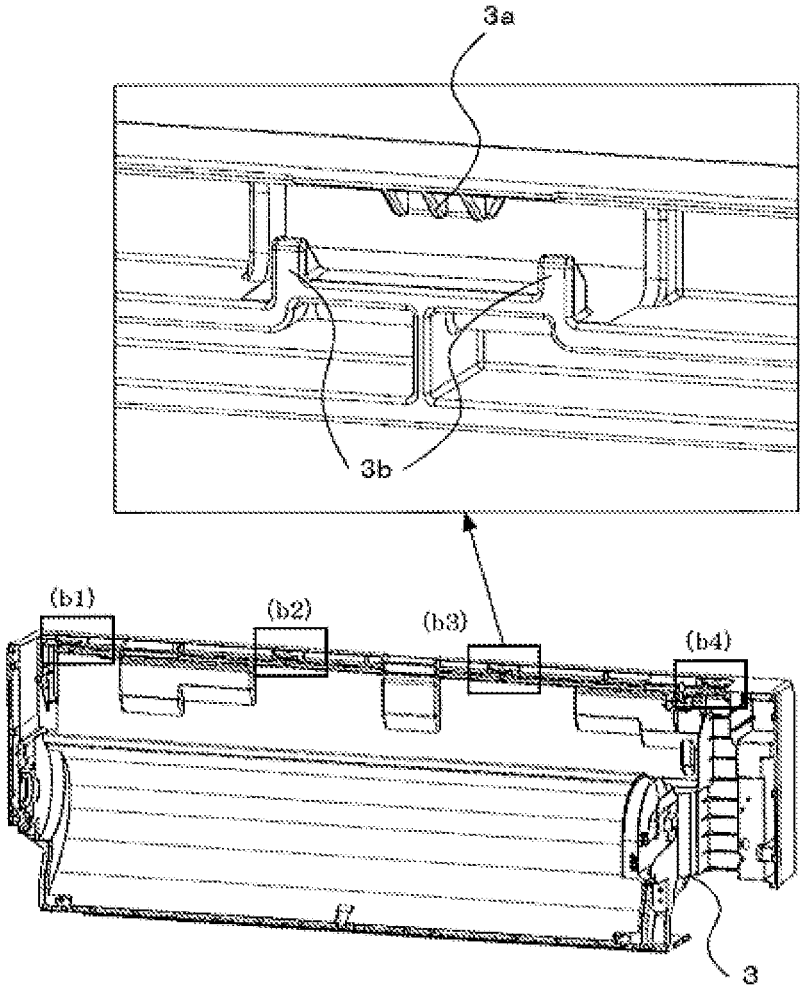
FIG. 4 is a view illustrating a base body 3 of the air-conditioning apparatus 100 according to the embodiment of the present invention.

FIG. 3 is a view illustrating the frame body 2 of the air-conditioning apparatus 100 according to the embodiment of the present invention. FIG. 4 is a view illustrating the base body 3 of the air-conditioning apparatus 100 according to the embodiment of the present invention. A structure of the frame body 2 is described first, and a structure of the base body 3 is subsequently described.

As shown in FIG. 3, a frame body-side engagement section 2*a* and an extension section 2*b* are provided at a back-surface upper end portion of the frame body 2. A plurality of frame body-side engagement sections 2*a* are provided so as to project backward from the frame body 2. For example, four frame body-side engagement sections 2*a* are provided at predetermined intervals in a horizontal direction. Each of the frame body-side engagement sections 2*a* is provided with a frame body-side claw portion 2*a*1 and a recessed portion 2*a*2. The frame body-side claw portion 2*a*1 and the recessed portion 2*a*2 are described in detail later.

The extension section 2*b* is provided so as to extend backward from the frame body 2, and is provided to the right and the left (both sides) of the frame body-side engagement section 2*a* with a gap therebetween. The single extension section 2*b* may be provided to each of the right and the left of the single frame body-side engagement section 2*a* as shown in FIG. 3, or, for example, a plurality of (e.g., two) extension sections 2*b* may be provided to each of the right and the left of the single frame body-side engagement section 2*a*.

Note that partially enlarged views of (a1), (a2), and (a4) are similar to a partially enlarged view of (a3) although only the partially enlarged view of (a3) in FIG. 3 is shown in FIG. 3.

Also, although the example in which the frame body-side engagement section 2*a* and the extension section 2*b* are provided at the back-surface upper end portion of the frame body 2 has been described, the present invention is not limited thereto. For example, the frame body-side engagement section 2*a* and the extension section 2*b* may be provided below the back-surface upper end portion of the frame body 2.

As shown in FIG. 4, a base body-side engagement section 3*a* and a support base 3*b* are provided at a front-surface upper end portion of the base body 3. The base body-side engagement section 3*a* is provided with a base body-side claw portion 3*a*1 (described later). The base body-side engagement section 3*a* engages with the frame body-side engagement section 2*a*, and, for example, three base body-side engagement sections 3*a* are provided side by side. The support base 3*b* is a member that supports the extension section 2*b*, and, for example, two support bases 3*b* are provided. The support bases 3*b* are respectively provided below both sides of the base body-side engagement sections 3*a*. The base body-side claw portion 3*a*1 and the support base 3*b* are described in detail later.

Note that partially enlarged views of (b1), (b2), and (b4) are similar to a partially enlarged view of (b3) although only the partially enlarged view of (b3) in FIG. 4 is shown in FIG. 4.

Also, although the example in which the base body-side engagement section 3*a* and the support base 3*b* are provided at the front-surface upper end portion of the base body 3 has been described, the present invention is not limited thereto. For example, the base body-side engagement section 3*a* and the support base 3*b* may be provided below the front-surface upper end portion of the base body 3.

Figure 5:
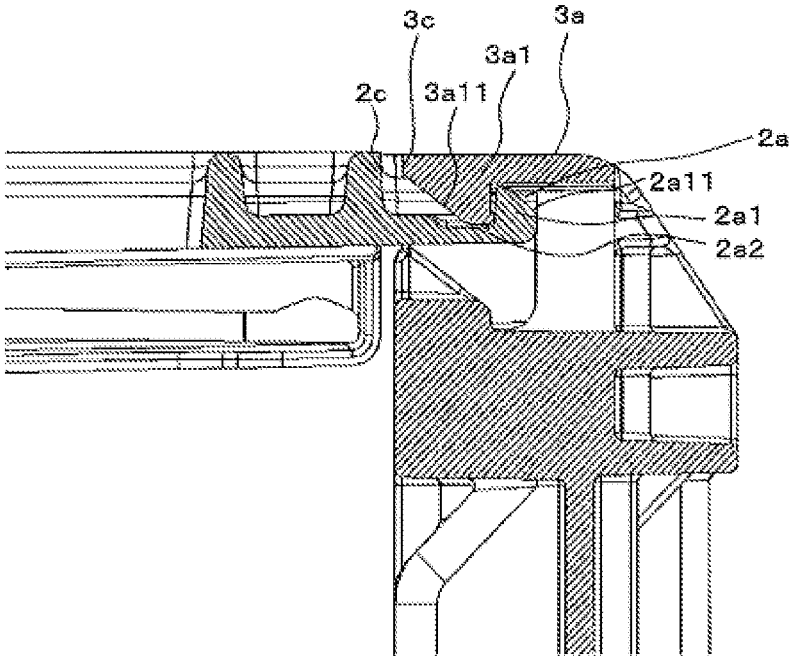
FIG. 5 is a vertical sectional view of a frame body-side engagement section 2*a* and a base body-side engagement section 3*a* at the time of assembling of the air-conditioning apparatus 100 according to the embodiment of the present invention.
Figure 6:
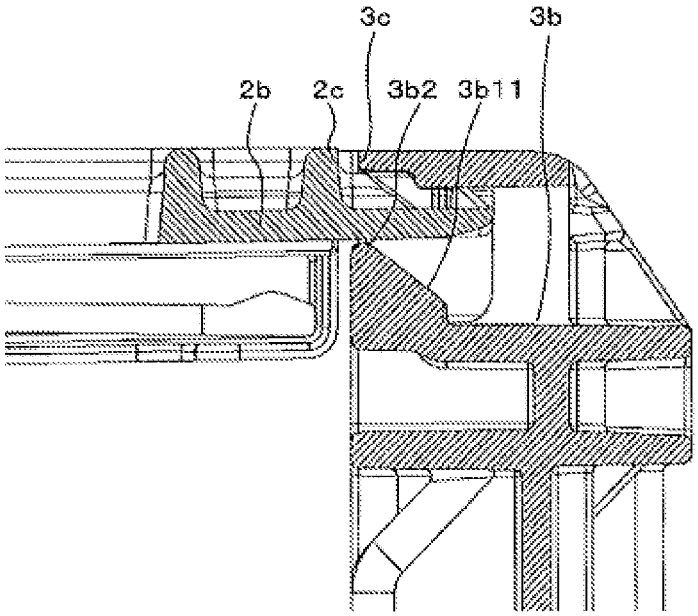
FIG. 6 is a vertical sectional view of an extension section 2*b* and a support base 3*b* at the time of assembling of the air-conditioning apparatus 100 according to the embodiment of the present invention.

FIG. 5 is a vertical sectional view of the frame body-side engagement section 2*a* and the base body-side engagement section 3*a* at the time of assembling of the air-conditioning apparatus 100 according to the embodiment of the present invention. FIG. 6 is a vertical sectional view of the extension section 2*b* and the support base 3*b* at the time of assembling of the air-conditioning apparatus 100 according to the embodiment of the present invention. A state in which the frame body 2 is attached to the base body 3 is described by using FIGS. 5 and 6.

As shown in FIG. 5, the frame body-side claw portion 2*a*1 is a portion where an inclined surface 2*a*11 is provided to be inclined downward toward a rear side of the frame body 2, and projects upward. The frame body-side claw portion 2*a*1 is configured into, for example, a right-angled triangular shape with the inclined surface 2*a*11 as a hypotenuse when the frame body 2 is viewed in side view. The recessed portion 2*a*2 is provided in a portion of the frame body-side engagement section 2*a* in abutment with the base body-side engagement section 3*a*, and has a downwardly recessed shape. By providing the recessed portion 2*a*2 as described above, an engagement allowance between the frame body 2 and the base body 3 can be ensured.

Note that although the example in which the recessed portion 2*a*2 is provided in the frame body-side engagement section 2*a* has been described, the present invention is not limited thereto. For example, a recessed portion may be provided in a portion of the base body-side engagement section 3*a* in abutment with the frame body-side engagement section 2*a*.

As shown in FIG. 5, the base body-side claw portion 3*a*1 is a portion where an inclined surface 3*a*11 is provided to be inclined downward toward a rear side of the base body 3, and projects downward. The base body-side claw portion 3*a*1 is configured into, for example, a right-angled triangular shape with the inclined surface 3*a*11 as a hypotenuse when the base body 3 is viewed in side view.

As shown in FIG. 6, the support base 3*b* is a portion that is located below the extension section 2*b* and supports the extension section 2*b*, and is provided with an inclined surface 3*b*11 and a support surface 3*b*2. The inclined surface 3*b*11 is a surface inclined downward toward the rear side of the base body 3. The support base 3*b* has, for example, a right-angled triangular shape with the inclined surface 3*b*11 as a hypotenuse in side view. The support surface 3*b*2 is a surface that supports the extension section 2*b*, and is in abutment with a lower surface of the extension section 2*b*. Note that the support surface 3*b*2 is located ahead of the frame body-side engagement section 2*a* in a state in which the frame body 2 is mounted to the base body 3.

As shown in FIGS. 5 and 6, a frame body-side abutment section 2*c* is provided in the frame body 2, and a base body-side abutment section 3*c* is provided in the base body 3. The frame body-side abutment section 2*c* is a portion in abutment with the base body-side abutment section 3*c* when the frame body 2 is mounted to the base body 3. The base body-side abutment section 3*c* is a portion in abutment with the frame body-side abutment section 2*c* when the frame body 2 is mounted to the base body 3.

In a state in which the frame body 2 is attached to the base body 3, the frame body-side engagement section 2*a* and the base body-side engagement section 3*a* engage with each other as shown in FIG. 5, and the extension section 2*b* is supported by the support base 3*b* as shown in FIG. 6. When the frame body-side engagement section 2*a* and the base body-side engagement section 3*a* engage with each other as described above, forward movement of the frame body 2 is restricted. Also, when the extension section 2*b* is supported by the support base 3*b*, downward movement of the frame body 2 is restricted. Note that the support base 3*b* supports the extension section 2*b* at a position of the main body 1 ahead of a position where the frame body-side engagement section 2*a* and the base body-side engagement section 3*a* engage with each other.

The frame body 2 is fixed to the base body 3 by attaching the frame body 2 to the base body 3 by use of a member such as a screw (not shown) at a lower portion of the frame body 2 and a lower portion of the base body 3 in a state in which the frame body-side engagement section 2*a* and the base body-side engagement section 3*a* engage with each other as shown in FIG. 5, and the extension section 2*b* is supported by the support base 3*b* as shown in FIG. 6.

Figure 7:
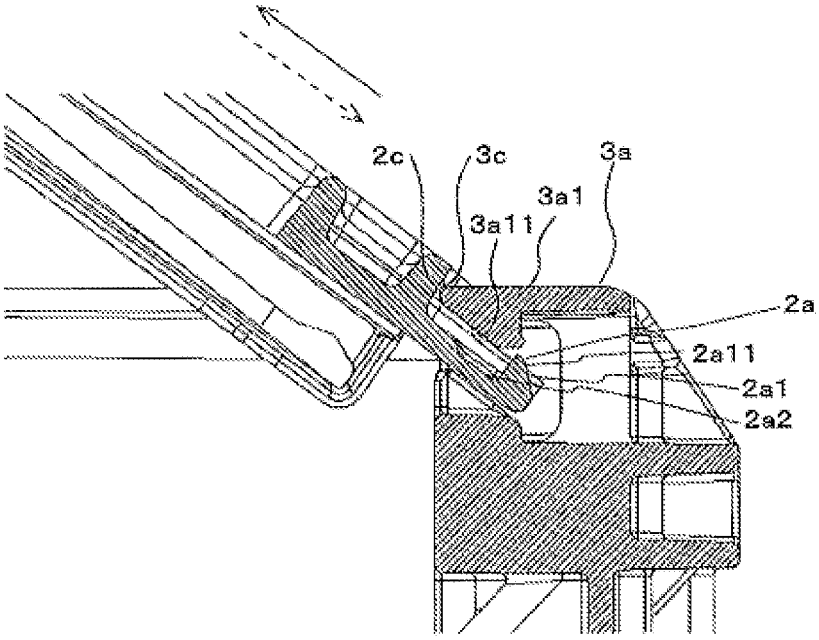
FIG. 7 is a vertical sectional view of the frame body-side engagement section 2*a* and the base body-side engagement section 3*a* at the time of attachment and detachment of the air-conditioning apparatus 100 according to the embodiment of the present invention.
Figure 8:
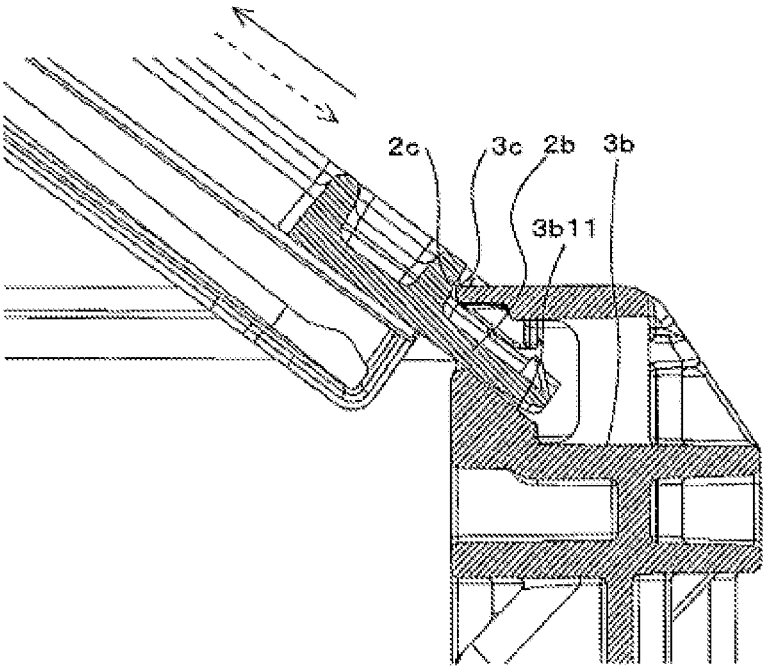
FIG. 8 is a vertical sectional view of the extension section 2*b* and the support base 3*b* at the time of attachment and detachment of the air-conditioning apparatus 100 according to the embodiment of the present invention.

FIG. 7 is a vertical sectional view of the frame body-side engagement section 2*a* and the base body-side engagement section 3*a* at the time of attachment and detachment of the air-conditioning apparatus 100 according to the embodiment of the present invention. FIG. 8 is a vertical sectional view of the extension section 2*b* and the support base 3*b* at the time of attachment and detachment of the air-conditioning apparatus 100 according to the embodiment of the present invention.

In the following, (a) a procedure for removing the frame body 2 from the base body 3, and (b) a procedure for mounting the frame body 2 to the base body 3 are described by using FIGS. 7 and 8.

(a) Procedure for removing the frame body 2 from the base body 3

First, the frame body 2 is inclined by lifting a front surface side of the frame body 2 in a state in which the frame body 2 is mounted to the base body 3 as shown in FIGS. 5 and 6. Accordingly, as shown in FIGS. 7 and 8, the frame body 2 rotates with the support base 3*b* as a fulcrum to be inclined, and an engagement state between the frame body-side claw portion 2*a*1 and the base body-side engagement section 3*a* is released. Subsequently, a force is applied to a front and upper side of the frame body 2 (a direction of a solid arrow in FIGS. 7 and 8). Here, since the inclined surface 3*b*11 is provided in the support base 3*b*, an angle of the frame body 2 is adjusted (guided) to the same angle as the inclined surface 3*b*11 when the force is applied to the front and upper side of the frame body 2. When the force is further applied to the front and upper side of the frame body 2, the frame body 2 is removed from the base body 3.

(b) Procedure for mounting the frame body 2 to the base body 3

First, the frame body 2 is inclined by lifting the front side of the frame body 2. Subsequently, the frame body 2 is pushed into the base body 3 in a state in which the frame body 2 is moved such that the frame body-side engagement section 2*a* and the extension section 2*b* are located between the base body-side engagement section 3*a* and the support base 3*b* (a direction of a dotted arrow in FIGS. 7 and 8). Here, since the inclined surface 3*b*11 is provided in the support base 3*b*, the angle of the frame body 2 is adjusted (guided) to the same angle as the inclined surface 3*b*11 when the frame body 2 is pushed into the base body 3. When the frame body 2 is further pushed into the base body 3, the frame body-side abutment section 2*c* and the base body-side abutment section 3*c* come into abutment with each other, and a force for pushing the frame body 2 into the base body 3 is restricted. In a state in which the frame body 2 is pushed into the base body 3 as described above, the frame body 2 is made horizontal by moving the front surface side of the frame body 2 downward. Accordingly, the frame body-side engagement section 2*a* and the base body-side engagement section 3*a* engage with each other, and the extension section 2*b* is supported by the support base 3*b* as shown in FIGS. 5 and 6.

As described above, the air-conditioning apparatus 100 according to the present embodiment includes the main body 1 including the frame body 2 and the base body 3 provided on the back surface side of the frame body 2, the frame body-side engagement section 2*a* and the extension section 2*b* that extends backward on the both sides of the frame body-side engagement section 2*a* are provided on the back side of the frame body 2, the base body-side engagement section 3*a* that engages with the frame body-side engagement section 2*a*, and the support base 3*b* that is located below the extension section 2*b* are provided on the front side of the base body 3, and when the frame body 2 is mounted to the base body 3, the frame body-side engagement section 2*a* and the base body-side engagement section 3*a* engage with each other, and the extension section 2*b* is supported by the support base 3*b*.

As described above, when the frame body 2 is mounted to the base body 3, the frame body-side engagement section 2*a* and the base body-side engagement section 3*a* engage with each other, and the extension section 2*b* is supported by the support base 3*b*. Thus, the engagement allowance can be ensured, and the air-conditioning apparatus 100 in which the frame body 2 and the base body 3 are in a firm engagement state can be obtained.

Also, for example, at the time of maintenance of the air-conditioning apparatus 100, the engagement state between the frame body 2 and the base body 3 can be released by rotating the frame body 2 with the support base 3*b* as a fulcrum. Thus, the engagement state between the frame body 2 and the base body 3 can be easily released.

Therefore, the air-conditioning apparatus 100 with good operability can be obtained.

Also, the inclined surface 2*a*11 is provided in the frame body-side engagement section 2*a*. Therefore, even if the frame body 2 and the base body 3 come into contact with each other while the frame body 2 is being pushed into the base body 3 in a case in which the frame body 2 is mounted to the base body 3, the frame body 2 and the base body 3 are less likely to be damaged.

Also, the inclined surface 3*a*11 is provided in the base body-side engagement section 3*a*. Therefore, even if the frame body 2 and the base body 3 come into contact with each other while the frame body 2 is being pushed into the base body 3 in a case in which the frame body 2 is mounted to the base body 3, the frame body 2 and the base body 3 are less likely to be damaged.

Also, the inclined surface **3*b*11 is provided in the support base 3*b*. Therefore, when the frame body 2 is mounted to the base body 3, the support base 3*b* guides a direction in which the frame body 2 is pushed, and when the frame body 2 is removed from the base body 3, the support base 3*b* guides a direction in which the frame body 2 is removed. Accordingly, the air-conditioning apparatus 100** with good operability can be obtained.

Note that an inclination angle of the inclined surface **3*b*11 of the support base 3*b* is desirably configured to match an inclination angle of the frame body 2 when the frame body 2 is removed. Accordingly, the operation of mounting the frame body 2 to the base body 3 can be facilitated, and the operation of removing the frame body 2 from the base body 3 can be facilitated. Therefore, the air-conditioning apparatus 100** with good operability can be obtained.

Note that the inclined surface **2*a*11** corresponds to a "first inclined surface" in the present invention.

Also, the inclined surface **3*a*11** corresponds to a "second inclined surface" in the present invention.

Also, the inclined surface **3*b*11** corresponds to a "third inclined surface" in the present invention.

REFERENCE SIGNS LIST

1 Main body
2 Frame body
**2*a*** Frame body-side engagement section
**2*a*1** Frame body-side claw portion
**2*a*11** Inclined surface
**2*a*2** Recessed portion
**2*b*** Extension section
**2*c*** Frame body-side abutment section
3 Base body
**3*a*** Base body-side engagement section
**3*a*1** Base body-side claw portion
**3*a*11** Inclined surface
**3*b*** Support base
**3*b*11** Inclined surface
**3*b*2** Support surface
**3*c*** Base body-side abutment section
4 Heat exchanger
5 Electric parts box
6 Air blowing unit
7 Drain pan unit
8 Installation plate
100 Air-conditioning unit

The invention claimed is:

1. An air-conditioning apparatus comprising:

a main body including a frame body and a base body, the base body being provided on a back surface side of the frame body, the base body forming an air flow path of an air conditioning apparatus blowing unit, the air conditioning apparatus blowing unit being attached to the base body, wherein the frame body includes, on a back side thereof:

a frame body-side engagement section, and an extension section, the extension section extending backward on both sides of the frame body-side engagement section, the base body includes, on a front side thereof:

a base body-side engagement section that engages with the frame body-side engagement section, and a support base that is separate from the base body-side engagement section and that is located below the extension section when the base body-side engagement section engages with the frame body-side engagement section, the frame body-side engagement section includes a frame body-side claw portion that projects upward and has a first inclined surface that is inclined downward toward a rear side of the frame body, the base body-side engagement section includes a base body-side claw portion that projects downward and has a second inclined surface that is inclined downward toward a rear side of the base body, and when the frame body is mounted to the base body, the frame body-side claw portion of the frame body-side engagement section engages with the base body-side claw portion of the base body-side engagement section from below, and the extension section is supported by the support base from below.

2. The air-conditioning apparatus of claim 1, wherein a part of at least one of the frame body-side claw portion, the base body-side claw portion, and the extension section has a generally right-angled triangular shape in side view.

3. The air-conditioning apparatus of claim 1, wherein the support base supports the extension section at a position of the main body ahead of a position where the frame body-side engagement section and the base body-side engagement section engage with each other.

4. The air-conditioning apparatus of claim 1, wherein the support base has a third inclined surface that is inclined downward toward the rear side of the base body.

5. The air-conditioning apparatus of claim 1, wherein a recessed portion is provided in a portion of one of the frame body-side engagement section and the base body-side engagement section in abutment with the other of the frame body-side engagement section and the base body-side engagement section.

* * * * *